US010240394B1

(12) United States Patent
Crampton

(10) Patent No.: US 10,240,394 B1
(45) Date of Patent: Mar. 26, 2019

(54) SLIP-RESISTANT SUPPORT BASE AND METHOD OF MAKING

(71) Applicant: Working Concepts, Inc., Gresham, OR (US)

(72) Inventor: Richard H. Crampton, Gresham, OR (US)

(73) Assignee: WORKING CONCEPTS, INC., Gresham, OR (US)

( * ) Notice: Subject to any disclaimer, the term of this patent is extended or adjusted under 35 U.S.C. 154(b) by 0 days.

(21) Appl. No.: 15/897,039

(22) Filed: Feb. 14, 2018

Related U.S. Application Data

(60) Provisional application No. 62/459,781, filed on Feb. 16, 2017.

(51) Int. Cl.

| | |
|---|---|
| ***E06C 7/46*** | (2006.01) |
| ***E06C 7/44*** | (2006.01) |
| ***E06C 7/08*** | (2006.01) |
| *E06C 7/18* | (2006.01) |

(52) U.S. Cl.
CPC ..... *E06C 7/46* (2013.01); *E06C 7/081* (2013.01); *E06C 7/44* (2013.01); *E06C 7/188* (2013.01)

(58) Field of Classification Search
CPC ... E06C 7/46; E06C 7/44; E06C 7/188; B32B 25/045
See application file for complete search history.

(56) References Cited

U.S. PATENT DOCUMENTS 3,025,200 A * 3/1962 Powers ..... C08J 9/38 264/321
3,082,483 A * 3/1963 Bickford ..... C08J 9/36 156/252
3,726,028 A * 4/1973 Stokes ..... A43B 3/00 182/230
3,841,958 A * 10/1974 Delorme ..... B29C 44/186 428/117

(Continued)

FOREIGN PATENT DOCUMENTS

GB 2465555 B * 10/2010 ..... E06C 7/42

OTHER PUBLICATIONS

TB Davies Ltd., Ladder Base, Jan. 19, 2018, 4 pages, https://www.tbdavies.co.uk/products/ladder-accessories/ladder-base/.

(Continued)

*Primary Examiner* — Colleen M Chavchavadze
(74) *Attorney, Agent, or Firm* — Kolisch Hartwell, P.C.

(57) ABSTRACT

A slip-resistant support base and method of making and using such a support base. A slip-resistant support base may include a resilient pad having an exposed lower expanse opposite an upper pad surface, the lower expanse being characterized by a two-dimensional distribution of downwardly open concave recesses having rims forming a lower extremity of the support base. The lower expanse may be made by shearing off a layer of a first major face of a pad of resilient closed cell foam to expose an expanse of cut cells. In some examples, the support base includes a body and the resilient pad as a resilient substrate. The body is preferably configured to support an external object positioned on a body upper surface. The resilient substrate is preferably attached to and extends along at least a portion of a body lower surface. The resilient substrate lower expanse is opposite the body lower surface.

14 Claims, 3 Drawing Sheets

(56) References Cited

U.S. PATENT DOCUMENTS

| | | | | |
|---|---|---|---|---|
| 5,154,255 | A | 10/1992 | Kiska et al. | |
| 5,570,864 | A * | 11/1996 | Flores | E04G 3/26 248/148 |
| 5,791,438 | A | 8/1998 | Kempton | |
| 5,887,406 | A * | 3/1999 | Bond | E04D 15/00 182/45 |
| 6,216,819 | B1 * | 4/2001 | Cougar | E04D 15/00 182/230 |
| 6,490,842 | B2 * | 12/2002 | Emmons | E04D 15/00 182/45 |
| 7,186,908 | B2 * | 3/2007 | Hodesh | G10D 3/163 84/320 |
| 9,145,687 | B1 * | 9/2015 | Bancroft | E06C 1/10 |
| 9,186,863 | B2 * | 11/2015 | Day | B29C 70/086 |
| 2005/0173190 | A1 * | 8/2005 | Garrett | B23D 45/003 182/45 |
| 2008/0156585 | A1 * | 7/2008 | Pyktel | E06C 7/46 182/108 |
| 2009/0200110 | A1 * | 8/2009 | Esselborn | E06C 7/46 182/107 |
| 2010/0307869 | A1 * | 12/2010 | Hazuka, II | E04G 3/26 182/141 |
| 2011/0100752 | A1 * | 5/2011 | Donlon | E06C 7/42 182/107 |
| 2014/0134424 | A1 * | 5/2014 | Hsu | B32B 27/08 428/319.9 |
| 2014/0311826 | A1 * | 10/2014 | Beardman | E06C 7/46 182/107 |
| 2016/0053539 | A1 * | 2/2016 | Hopkins | E06C 7/42 182/111 |
| 2016/0369563 | A1 * | 12/2016 | Adcock | E06C 7/46 |
| 2017/0252900 | A1 * | 9/2017 | Kolthoff | B24D 13/147 |

OTHER PUBLICATIONS

Lansford Access Ltd., Ladder Feet & Bungs, Jan. 23, 2018, 4 pages, https://www.ladders-999.co.uk/ladder-feet-bungs?limit=all.

Alibaba Group, Ladder Stopper Mat, Ladder Mat, Ladder Stop Mat, Jan. 19, 2018, 5 pages, https://ideamake.en.alibaba.com/product/60072614099-200573223/Lader_Stopper_Mat_ . . .

Lansford Access Ltd., Ladder Feet & Bungs, Articulating Rubber Feet, Jan. 23, 2018, 2 pages, https://www.ladders999.co.uk/ladder-feet-bungs/articulating-rubber-feet.html.

Laddermat Co., For when you spend a long time at height. Pro-Footee anti-slip device., Jan. 19, 2018, 3 pages, http://www.laddermat.co.uk/pro-footee-anti-slip-device/.

Rojak Design, The Rojak Stopper, Jan. 19, 2018, 5 pages, https://www.rojak.co.uk/products/bollom-stability/the-rojak-stopper/.

Ladder M8RIX, The Ladder M8rix Professional, Jan. 19, 2018, 4 pages, https://www.ladderm8.co.uk/product/the-ladder-m8rix-professional/.

* cited by examiner

SLIP-RESISTANT SUPPORT BASE AND METHOD OF MAKING

RELATED APPLICATIONS

This application claims the benefit of U.S. Provisional Application No. 62/459,781, filed Feb. 16, 2017, titled Slip-Resistant Support Base, which provisional application is incorporated herein by reference in its entirety for all purposes.

BACKGROUND

Supporting objects on slippery surfaces is usually only reliable if the object applies a vertically downward force on the slippery surface. For example, placement of tall objects, such as poles, boards, and ladders, are often positioned so they lean against a tall stable object, such as a wall or roof. This puts a significant lateral or horizontal force on the foot of the object supported on the surface. If the surface under the object is smooth, the foot of the object tends to slip away from the object it is leaning against.

In particular, falling from ladders is one of the major safety issues in the workplace and particularly in construction. Ideally, ladders are placed on firm, level surfaces that provide a reliable grip for the feet of the ladders. Ladders often get set up on any surface that exists, regardless of whether it is smooth, textured, uneven, or slippery. For example, ladders often get set up on relatively smooth surfaces like waxed floors or artificial decks and don't have safety feet designed to keep them from slipping out from under the worker. Safety experts recommend that If the worker is not able to set up his or her ladder on a firm, level surface, the worker shouldn't set up the ladder at all. However, the exigencies of work and the over-confidence of the worker often leads to ladders being used in less than the safest conditions. Intermediary support bases exist that improve the stability of ladders on various surfaces, but they may still be subject to slippage on particularly smooth, wet, or other slippery surfaces.

SUMMARY

The present disclosure provides a slip-resistant support base and method of making and using such a support base. In some embodiments, a slip-resistant support base may include a resilient pad having an exposed lower expanse opposite an upper pad surface, the lower expanse being characterized by a two-dimensional distribution of downwardly open concave recesses having rims forming a lower extremity of the support base. In some examples, the support base includes a body and the resilient pad as a resilient substrate. The body preferably is configured to support an external object positioned on a body upper surface. The resilient substrate is preferably attached to and extends along at least a portion of a body lower surface. The resilient substrate lower expanse is opposite the body lower surface.

In some embodiments, a slip-resistant support base includes a rigid plate, a strap, a barrier, and a resilient substrate. The rigid plate has a plate upper surface and a plate lower surface, the plate being configured to support at least one foot of a ladder positioned on the support base over the plate upper surface. The strap is attached to the plate upper surface and configured to be manually secured to and non-destructively released from a rung of the ladder when the ladder is positioned on the support base. The barrier is fixedly attached to the plate and configured to extend upwardly above the plate upper surface, wherein the barrier is configured to limit movement of the at least one ladder foot along the plate upper surface in at least one direction when the at least one ladder foot is supported on the support base. The resilient substrate is made of a closed cell foam and is attached to and extends along at least a portion of the plate lower surface. The resilient substrate has an exposed lower expanse opposite the plate lower surface produced by shearing off a layer of the closed cell foam. This lower expanse is characterized by a two-dimensional distribution of open concave cut cells facing downwardly, with the cut cells being distributed in a common plane and having a density on the lower expanse of between five cut cells per square inch and fifty cut cells per square inch.

These and other slip-resistant support bases may be formed by shearing off a layer of a pad first major face of a pad of resilient closed cell foam to expose an expanse of cut cells. A pad second major face of the pad opposite the pad first major face may be attached to a plate first major face of a rigid plate. In some examples, a barrier may be attached to a second major face of the plate opposite the plate first major face. The barrier may be configured to limit movement of at least one ladder foot along the plate second major face in at least one direction Features, functions, and advantages may be achieved independently in various embodiments of the present disclosure, or may be combined in yet other embodiments, further details of which can be seen with reference to the following description and drawings.

DESCRIPTION

Various embodiments of slip-resistant support bases having resilient substrates with exposed downward facing recesses are described below and illustrated in the associated drawings. Unless otherwise specified, such a support base and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may but are not required to be, included in other support apparatuses. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Generally, a slip-resistant support base preferably may include a body having a body upper surface and a rigid body lower surface wherein the body is configured to support an external object (external to the support base) positioned on the body upper surface. A resilient substrate is attached to and extends along at least a portion of the body lower surface. The resilient substrate has an exposed lower expanse opposite the body lower surface, which lower expanse is characterized by a two-dimensional distribution of downwardly open concave recesses having rims forming a lower extremity of the support base.

Such a support base is particularly useful for maintaining the object in a fixed position relative to a surface, referred to as an external surface such as a building floor, deck, or paved area, on which the support base is placed. This support base is particularly beneficial when the external object applies a lateral or horizontal force to the support base. Such a slip-resistant support base is intended particularly for use as an accessory item that supports the feet of structures, such as extension or other ladders, to reduce slippage on solid surfaces, such as plastic, wood, concrete, composite decks, or other similar floors. It includes the resilient substrate as a lower layer of floor matting structured to temporarily and non-destructively attach to or otherwise grip a floor surface.

Figure 1:
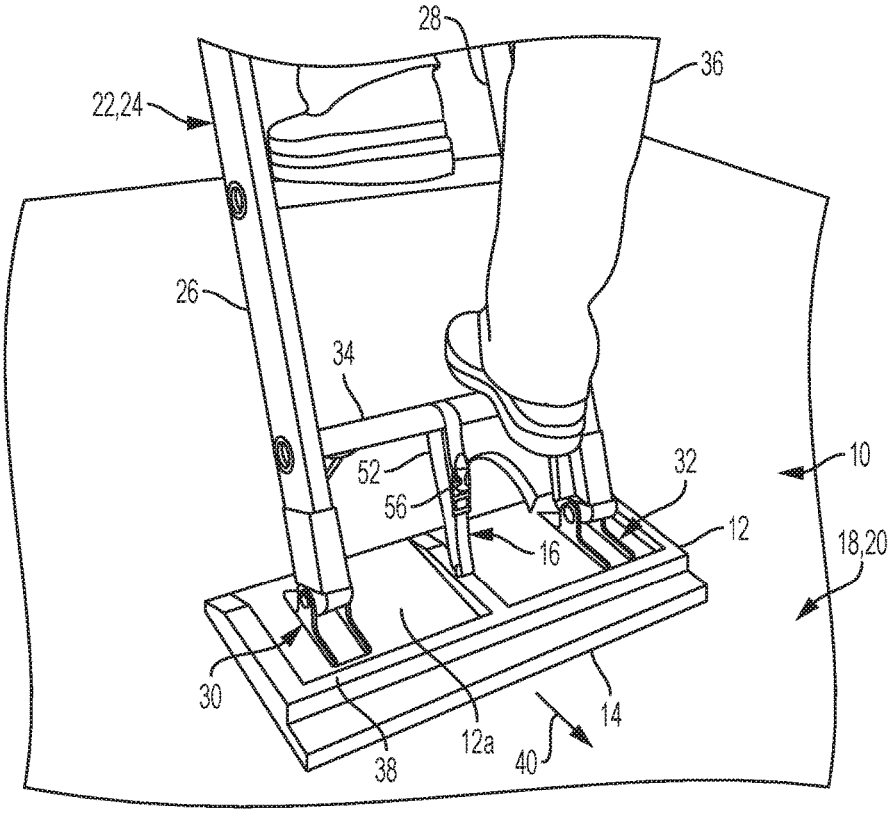
FIG. 1 is a perspective view of a first example of a slip-resistant support base.
Figure 2:
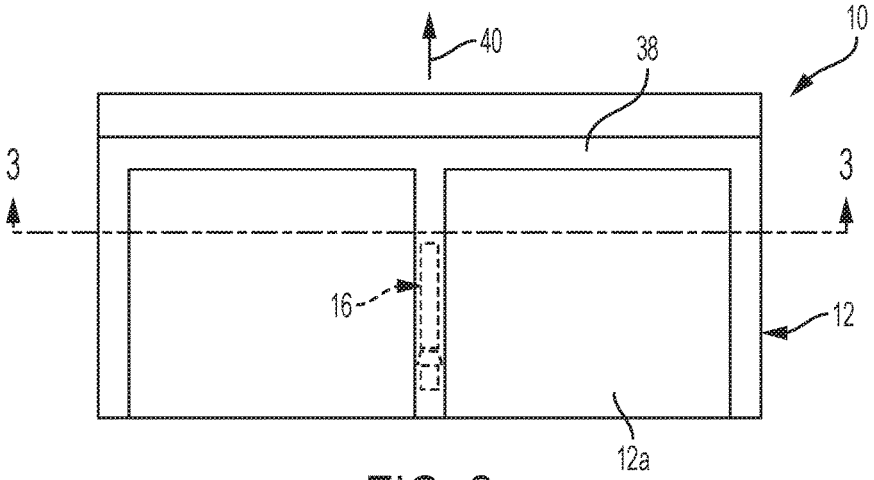
FIG. 2 is a top view of the support base of FIG. 1.
Figure 3:
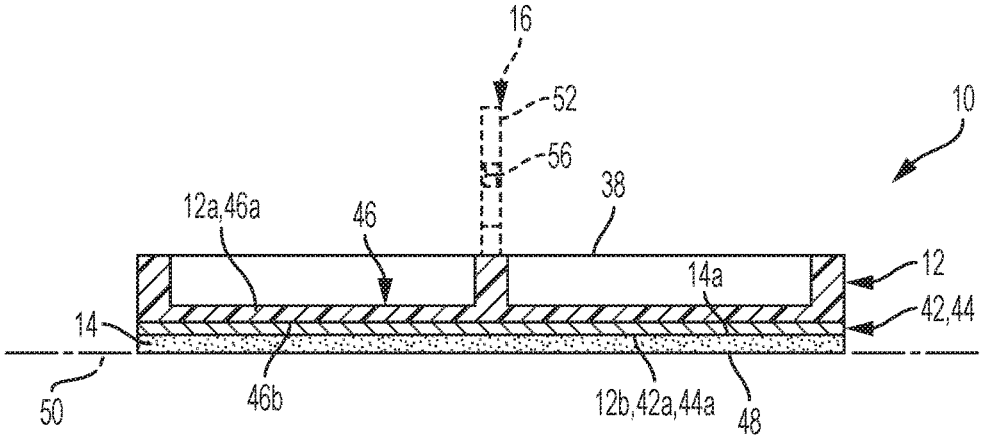
FIG. 3 is a cross-section taken along line 3-3 in FIG. 2.
Figure 4:
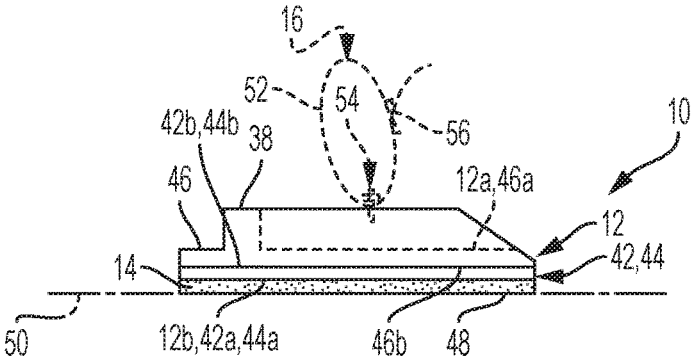
FIG. 4 is a side view taken from the left side of FIG. 2.

FIGS. 1-4 illustrate a first example of a slip-resistant support base, shown generally at 10. Support base 10 includes a body 12, a resilient substrate 14, and a securement device 16. FIG. 1 is a perspective view of support base 10 in use. FIG. 2 is a top view of the support base of FIG. 1; FIG. 3 is a cross-section taken along line 3-3 in FIG. 2; and FIG. 4 is a side view taken from the left side of FIG. 2.

Support base 10 is positioned on an external surface 18, such as a floor 20. A ladder 22, as an example of an external object 24, includes side rails 26, 28 having respective bottom feet 30, 32 positioned on support base 10. The ladder includes a plurality of rungs or steps, such as rung 34 extending between the side rails. A user 36 places ladder 22 against a structure (not shown) with feet 30, 32 positioned on a body upper surface 12*a*. The user may secure support base 10 to the ladder using an optional securement device 16, which is selectively manually securable to the ladder and manually non-destructively removable from the ladder. The user then climbs the ladder as shown.

Optionally, a barrier 38 may be mounted to body 12 to extend upwardly from body upper surface 12*a* to act in concert with securement device 16 to limit movement of the ladder feet along body upper surface 12*a* at least in a direction 40. As seen in FIG. 1, barrier 38 has an "E"-shape that includes two generally U-shaped stations for retaining the two feet of a typical extension ladder. With these shapes, barrier 38 limits movement of the ladder feet or other external object in directions toward the barriers from the station. Thus, when used as intended, the barriers limit travel of an external object both laterally as well as in direction 40.

In this example, side rail or barrier 38 extends up from the deck (where the ladder feet set) and generally around three sides of the perimeter of the deck. The barrier extends one inch high from support body upper surface 12*a* and is one inch wide. This rail is formed of urethane molded unitarily with the top layer 46 of the support body 12. This insures the ladder's correct placement and retention on the support base. As mentioned, the barrier includes a section extending from the rear section toward the front midway between the sides. This E-shaped rail adds strength to the base and assures that the weight of the ladder and a user is relatively evenly distributed over the extended surface area of the cut open cells on the bottom of the support base. The rigid plate 44, i.e., board 42 in this example, distributes the pressure from the foot of the ladder over a broad area of resilient substrate 14.

As shown in the figures, support base 10 may be a single piece as shown or it may be made as multiple pieces, i.e., one piece for each support element, such as ladder feet, that are supported, or for each station as defined by barrier 38. In this example of a single-piece construction for use with a conventional ladder having two feet, body 12 as shown in FIG. 2 has outer dimensions of 11.75 inches wide by 23.5 inches long by 2 inches high. Body 12 includes a 10.5 inch by 22 inch by 0.5 inch MDO (medium density overlay) plywood board 42, also referred to as a rigid plate 44, encapsulated in a 0.5 inch top layer 46, which along with integral barrier 38, is made of molded urethane. The MDO board 42 and encapsulant layer 46 together form a deck on which a ladder rests during use.

The MDO board has a smooth bottom or board lower surface 46*a* also referred to as a rigid plate lower surface 44*a* and body lower surface 12*b*, that is suitable for PSA (pressure sensitive adhesive) bonding to the foam rubber pad with the skived open cells exposed, facing away from the MDO board and toward a floor surface during use. Board 42 as plate 44 correspondingly has a board upper surface 42*b*, which is also plate upper surface 44*b*. Encapsulant layer 46 correspondingly has a layer upper surface 46*a* that forms body upper surface 12*a* and a layer lower surface 46*b* that is attached to board upper surface 42*b*. These surfaces are also referred to major faces of the respective layer components.

In this example, resilient substrate 14 has a substrate upper surface 14*a* attached to body lower surface 12*b* (plate lower surface 44*a*, board lower surface 42*a*) and is in the form of a foam rubber pad made of acrylonitrile butadiene extruded as a 0.5-inch thick foam with a layer, such as the skin, skived off of one side, as is illustrated in FIGS. 6A-6D described further below. This closed cell foam has cut open cells on one side that may function as distributed suction cups. The foam pad in this example is preferably 11.75 inches by 23.5 inches by 0.5 inch.

As mentioned, resilient substrate 14 is preferably a closed cell extruded rubber having one major face removed, such as by slicing, cutting, or skiving the skin off of the extrusion. This leaves a continuous resilient-substrate lower surface forming an exposed lower expanse 48 of cut open cells that may function as small, dense suction cups. Other techniques for forming a major face of a resilient material having recesses, such as cavities or other concave structures distributed two-dimensionally along the lower major face of the resilient substrate may also be used.

Preferably rims of the cut cells or other recesses form a lower extremity of the support base, are distributed in two dimensions, and are coplanar along a plane 50. In some examples, the rims and correspondingly recesses have a density on the resilient substrate lower expanse 48 of between five rims or recesses per square inch and fifty rims or recesses per square inch. In some examples, the rims of the recesses have a largest diameter that is less than one-quarter inch. Cell foam producing rims having a largest diameter that is less than one-sixteenth inch have been found to function well on many surfaces, including composite or plastic decking.

There are many different closed cell foams that may be used. Some may work better than others. Skiving foam rubbers is a process that is used to produce foam sheets out of molded or extruded buns that are uniform on each side. Skiving exposes cut cells, creating recesses that are like small suction cups that resist lateral motion along the surface on which the resilient pad is placed. This slip-resistant pad is intended to help reduce the number of accidents involving extension ladders slipping on low-friction decking, such as composite or plastic decking.

Securement device 16 secures support base 10 to ladder 22 or other external object, for ease in relocating the ladder and base during use since they can then be carried as a unit. Securement device 16 may be one of a variety of suitable structures. In this example, the securement device includes an adjustable nylon strap 52 that is attached to the center arm of barrier 38 on body 12 by a fastener 54, such as a screw and washer assembly. One end of strap 52 is attached to a spring clip or buckle 56. During use, the other end is wrapped over the bottom rung 34 of ladder 22 and secured to spring buckle 56 to form a loop, as shown in FIG. 1, that holds the support base to the ladder.

In another example, the adjustable strap may be made out of EPDM (ethylene propylenediene monomer (M-class)) rubber. The rubber strap may be 14 inches by 0.75 inches by 0.1875 inches with several holes punched on one inch centers for use on ladders having different spacings below the bottom rungs. This strap may be attached to an open-eye screw hook (such as model Zc 8R) that is screwed into the center rail section at the center of the support base. The strap goes up over the first rung of the ladder and back to the same open-eye screw hook. The screw hook may be three inches long and may be screwed through 1.5 inches of urethane and into 0.5 inches of the MDO (medium density overlay) board. The base may also be secured by a separate securement device associated with each foot of a ladder.

Figure 5:
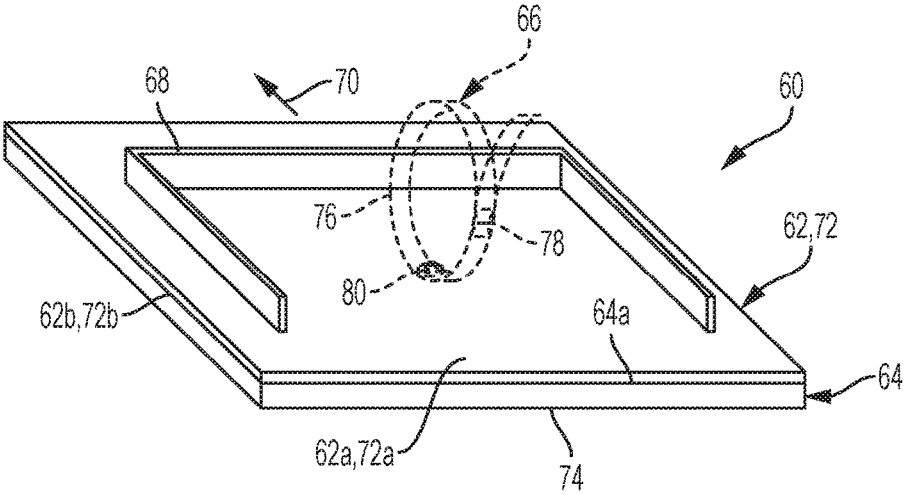
FIG. 5 is an isometric view of a second example of a slip-resistant support base.

FIG. 5 is an isometric view that illustrates a second example of a slip-resistant support base, shown generally at 60. Support base 60 can substitute for support base 10 and includes some features that are the same or similar to corresponding features of support base 10. Support base 60 includes a body 62, a resilient substrate 64, and optionally a securement device 66. Also optionally, a barrier 68 may be mounted to body 62 to extend upwardly from body upper surface 62*a* to act in concert with securement device 66 to limit movement of the ladder feet along body upper surface 62*a* at least in a horizontal direction 70.

Body 62 also has a rigid body lower surface 62*b* facing resilient substrate 64. In this example, body 62 is a rigid plate 72 having a corresponding plate upper surface 72*a* and a plate lower surface 72*b* preferably with the plate having dimensions of 23.75 inches by 11.75 inches. Plate 72 may be made of a suitable metal, such as 12 gauge aluminum. Other materials that provide a sufficiently strong and rigid plate may be used. Plate 72 is sufficiently rigid to distribute load forces over an area of resilient substrate 64 broader than the footprint of the object (ladder foot) supported on plate upper surface 72*a*.

Resilient substrate 64 may be the same as resilient substrate 14 described above with reference to support base 10. The description of resilient substrate 14 thus applies to resilient substrate 64. Accordingly, resilient substrate 64 includes a lower expanse 74 having downwardly facing recesses and has a substrate upper surface 64*a* attached to body lower surface 62*b* (plate lower surface 72*b*).

Barrier 68 is preferably made of 2.5 inch high 12-gauge aluminum flat bar that is stitched or welded to the upper surface of plate 72. Preferably, barrier 68 extends 21 inches along the rear portion of plate 72 (as viewed in FIG. 5) and spaced about 3.5 inches from the rear edge of body 62. Barrier 68 also preferably has arms that extend 7 inches along each side from the rear portion, about 1.38 inches from the side edges of plate 72, forming an overall "U" shape.

Securement device 66 may be the same as securement device 16, and may include a strap 76, a spring latch 78, and a fastener 80. Since plate 72 is made of comparatively thin sheet of aluminum, fastener 80 is preferably an elevator or carriage bolt extending upwardly through a square hole with a nut and washer securing the strap to plate 72.

In both or either of support bases 10 and 60, the resilient substrates are preferably attached to the body or plate with pressure sensitive adhesive, which is applied to the substrate upper surface opposite the lower expanse of the face having recesses. This allows the resilient substrate to be removed and replaced. During use, if the pad begins to loose resiliency or is otherwise damaged, it can be peeled off of the body or rigid plate and a new pad attached.

Figure 6A:
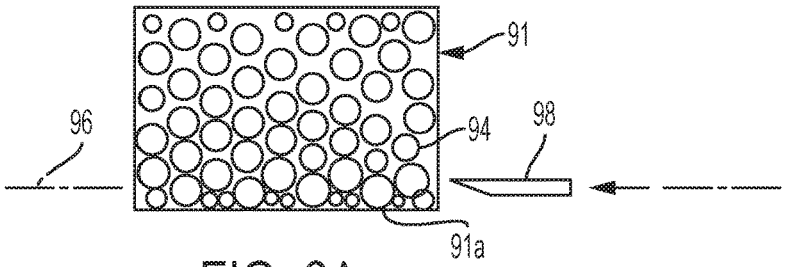
FIGS. 6A-6D are simplified illustrations of a method of making and using a third example of a slip-resistance support base.

FIGS. 6A-6D illustrate steps in a simplified example of a method of making and using a slip-resistant support base 90. Specifically, an extruded block of foam pad 91 having closed cells 94 is cut, such as by skiving, along a plane 96 parallel to a major face 91*a* of the foam pad. FIG. 6A illustrates foam pad 91 ready to be cut by a suitable cutter or blade 98.

Figure 6B:
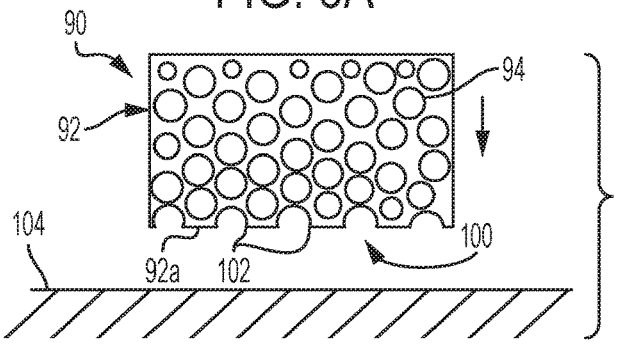

FIG. 6B illustrates a modified foam pad 92 resulting from a layer of foam pad 91 being cut off. Foam pad 92 has a resulting lower surface or expanse 92*a* having exposed cavities or recesses 100 that result from portions of cells 94 being sheared off. Pad 92 may be used alone as support base 90. Recesses 100 are distributed in two dimensions across the foam pad face. The recesses have rims 102 forming lower expanse 92*a*, which is the lower extremity of foam pad 92. For use, the foam pad is placed on a preferably horizontal external working surface 104, such as a floor, including a deck, cement pad, table top, counter top, roof, or the like.

Figure 6C:
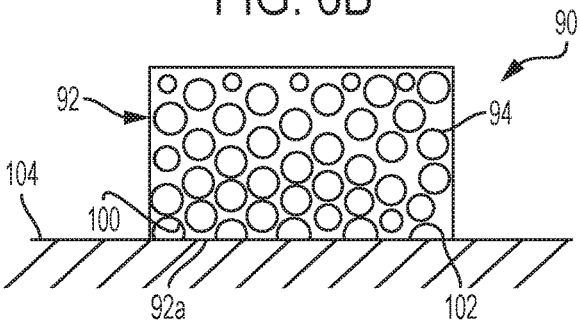

FIG. 6C shows foam pad 92 resting on working surface 104 with lower expanse 92*a* in contact with the working surface. With the foam pad in this position, the cut cell portions or recesses 100 face the working surface.

Figure 6D:
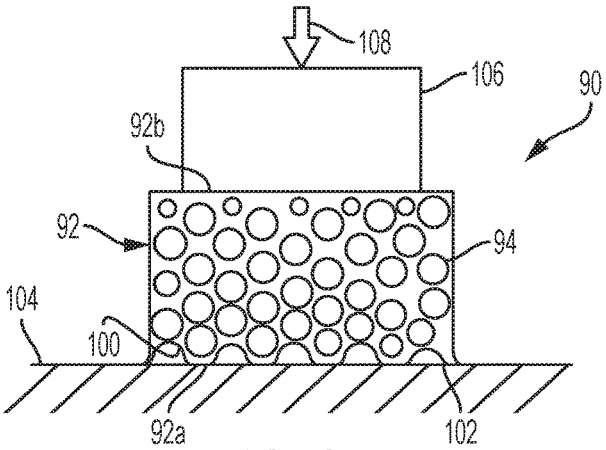

As shown in FIG. 6D, a body 106, such as a plate, is preferably supported on and attached to an upper surface 92*b* of pad 92, as has been described for support bases 10 and 60. Such a body or plate provides a rigid surface against the pad, which distributes laterally downward forces, represented by arrow 108, of a load, like a ladder and a person supported on the ladder, or other structure to be supported on a support surface. Such a load, when placed on the top of the foam pad or on top of body 106, presses the foam pad toward the floor. Since the foam pad is made of a resilient material, the foam pad is compressed, and the cut cells flatten somewhat, like suction cups, as they are pressed against the floor. This deformation also increases the number of recess rims in contact with the floor. When loaded in this way, the foam pad resists lateral movement along the floor. It is believed that at least some of the cells resist being moved along the working surface because of a slight vacuum or suction by the recesses, which tends to hold the pad, and thereby, the supported object, in place.

It will be appreciated from the above description that a slip-resistant support base includes a resilient pad having an exposed lower expanse opposite an upper pad surface, the lower expanse being characterized by a two-dimensional distribution of downwardly open concave recesses having rims forming a lower extremity of the support base. In some examples, the support base includes a body and the resilient pad as a resilient substrate. The body preferably is configured to support an external object positioned on a body upper surface. The resilient substrate is preferably attached to and extends along at least a portion of a body lower surface. The resilient substrate lower expanse is opposite the body lower surface.

The rims are preferably distributed in a common plane. The resilient pad or substrate may be a closed cell foam. The lower expanse may be produced by shearing off a layer of the closed cell foam. The body preferably includes a rigid plate having a lower face extending along the body lower surface. The lower face of the rigid plate preferably forms the body lower surface. In some examples, the resilient substrate is manually removable from the body lower surface without damaging the body lower surface. For example, the resilient substrate may be attached to the body lower surface by a pressure-sensitive adhesive.

The rims of the recesses preferably have a density on the resilient substrate lower expanse of between five rims per square inch and fifty rims per square inch. The rims of the recesses may have a largest diameter that is less than one-quarter inch, or more preferably is less than one-sixteenth inch.

A securement device may be secured to the body upper surface and configured to be secured to the external object. Such a securement device is preferably configured to be manually secured to and non-destructively released from the external object.

In some examples, then, a slip-resistant support base includes a rigid plate, a strap, a barrier, and a resilient substrate. The rigid plate has a plate upper surface and a plate lower surface, the plate being configured to support at least one foot of a ladder positioned on the support base over the plate upper surface. The strap is attached to the plate upper surface and configured to be manually secured to and non-destructively released from a rung of the ladder when the ladder is positioned on the support base. The barrier is fixedly attached to the plate and configured to extend upwardly above the plate upper surface, wherein the barrier is configured to limit movement of the at least one ladder foot along the plate upper surface in at least one direction when the at least one ladder foot is supported on the support base. The resilient substrate is made of a closed cell foam and is attached to and extends along at least a portion of the plate lower surface. The resilient substrate has an exposed lower expanse opposite the plate lower surface produced by shearing off a layer of the closed cell foam. This lower expanse is characterized by a two-dimensional distribution of open concave cut cells facing downwardly, with the cut cells being distributed in a common plane and having a density on the lower expanse of between five cut cells per square inch and fifty cut cells per square inch.

These and other slip-resistant support bases may be formed by shearing off a layer of a pad first major face of a pad of resilient closed cell foam to expose an expanse of cut cells. A pad second major face of the pad opposite the pad first major face may be attached to a plate first major face of a rigid plate. In some examples, a barrier may be attached to a second major face of the plate opposite the plate first major face. The barrier may be configured to limit movement of at least one ladder foot along the plate second major face in at least one direction when the at least one ladder foot is supported on the support base over the plate second major face when the support base is placed on an external surface with the expanse of cut cells in contact with the external surface.

Shearing off the layer of the pad first major face of the pad of closed cell foam may include shearing off the layer of the pad first major face of the pad of closed cell foam along a plane. Attaching the pad second major face of the pad to the plate first major face of the rigid plate may include attaching the pad second major face of the pad to the plate first major face of the rigid plate with a pressure sensitive adhesive. The pad of closed cell foam may be selected so that the exposed expanse of cut cells has a density of between five cut cells per square inch and fifty cut cells per square inch. The A strap may be secured to the plate second major face, which strap is configured to be manually secured to and non-destructively released from a rung of the ladder when the ladder is supported on the plate second major face.

Extension ladders in typical use are found to not slip when placed on a support base having the exposed expanse of a cut closed-cell foam extrusion. In other embodiments, such a resilient pad with distributed exposed cavities may be built into the feet of ladders, or may be separate bases with one for each ladder foot. Smaller individual foot versions provide improved traction over the more rigid plastic feet of conventional ladders. However, the reduced surface area may have diminishing effectiveness with increased weight and duration of use. The bases illustrated in the figures use a rigid planar plate on the resilient pad to distribute the weight applied by the ladder to a greater pad surface area. Thus, the illustrated bases, having a one piece structure, spread the forces applied by the ladder or other object over a greater area than support bases having smaller footprints. This increases the overall ability of the support base to resist movement along the working surface while reducing the overall force per square inch applied to the resilient substrate. The resilient pad has a further benefit of protecting attractive floors from the scuffing that ladders create on composite decks as well as on finished floors found in gymnasiums, shopping malls, and other facilities.

The slip-resistant pad as shown is a solution to a well known problem of extension ladders slipping when used on decks. This problem has been exacerbated with the popularity of composite (plastic) decking. Also increasing this problem is the environmental effort to build buildings higher, thereby increasing the use of extension ladders. Accidents on extension ladders are seldom minor.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

Where "a" or "a first" element or the equivalent thereof is recited, such usage includes one or more such elements, neither requiring nor excluding two or more such elements. Further, ordinal indicators, such as first, second, or third, for identified elements are used to distinguish between the elements in the order in which they are introduced, and do not indicate a required or limited number of such elements, and do not indicate a particular position or order of such elements unless otherwise specifically indicated. Accordingly, the ordinal indicator used for a particular element may vary in different contexts.

The invention claimed is:

1. A slip-resistant support base comprising:

a body having a body upper surface, a rigid body lower surface, and four sides, the body being configured to support an external object positioned on the body upper surface;

an E-shaped barrier fixedly attached to the body upper surface and configured to extend upwardly above the body upper surface, wherein the barrier includes an elongate portion extending along a first side of the body and first, second, and third sections extending from the elongate portion along the body upper surface toward a second side of the body opposite the first side, the first and second sections extending from respective opposite ends of the elongate portion and the third section extending from a position on the elongate portion intermediate between the first and second sections, there being no barrier extending along the second side from the first and second sections, whereby the barrier forms two external-object receiving stations separated by the third section with each station having the barrier on three sides and being open on a fourth side adjacent to the second side of the body; and a resilient substrate attached to and extending along at least a portion of the body lower surface, the resilient substrate having an exposed lower expanse opposite the body lower surface, the lower expanse being characterized by a two-dimensional distribution of downwardly open concave recesses.

2. The support base of claim 1, wherein the rims are distributed in a common plane.

3. The support base of claim 2, wherein the resilient substrate is a closed cell foam.

4. The support base of claim 3, wherein the lower expanse is produced by shearing off a layer of the closed cell foam.

5. The support base of claim 1, wherein the body includes a rigid plate having a lower face extending along the body lower surface.

6. The support base of claim 5, wherein the lower face of the rigid plate forms the body lower surface.

7. The support base of claim 1, wherein the resilient substrate is manually removable from the body lower surface without removing material of the body lower surface.

8. The support base of claim 7, wherein the resilient substrate is attached to the body lower surface by a pressure-sensitive adhesive.

9. The support base of claim 1, wherein the rims of the recesses have a density on the resilient substrate lower expanse of between five rims per square inch and fifty rims per square inch.

10. The support base of claim 1, wherein the rims of the recesses have a largest diameter that is less than one-quarter inch.

11. The support base of claim 10, wherein the rims of the recesses have a largest diameter that is less than one-sixteenth inch.

12. The support base of claim 1, further comprising a securement device secured to the third section of the barrier and configured to be manually secured to the external object.

13. The support base of claim 12, where the external object is a ladder having two feet, and wherein the securement device is configured to be manually secured to and released from a rung of the ladder when the ladder is positioned with a ladder foot in each station on the support base.

14. A slip-resistant support base comprising:

a rigid plate having a plate upper surface, a plate lower surface, and four sides, the plate being configured to support two feet of a ladder positioned on the support base over the plate upper surface;

an E-shaped barrier fixedly attached to the plate and configured to extend upwardly above the plate upper surface, wherein the barrier is configured to limit movement of the ladder feet along the plate upper surface in three directions when the ladder feet are supported on the support base, and the barrier includes an elongate portion extending along a first side of the plate and first, second, and third sections extending from the elongate portion along the plate upper surface toward a second side of the plate opposite the first side, the first and second sections extending from respective opposite ends of the elongate portion and the third section extending from a position on the elongate portion intermediate between the first and second sections, there being no barrier extending along the second side between the first and second sections, whereby the barrier forms two ladder-foot receiving stations separated by the third section with each station having the barrier on three sides and being open on a fourth side adjacent to the second side of the plate;

a strap attached to the third section of the barrier and configured to be manually secured to and released from a rung of the ladder when the ladder is positioned with a ladder foot in each station on the support base; and a resilient substrate made of a closed cell foam and attached to and extending along at least a portion of the plate lower surface, wherein the resilient substrate has an exposed lower expanse opposite the plate lower surface and the lower expanse is characterized by a two-dimensional distribution of downwardly open concave recesses.

* * * * *